United States Patent [19]

Nieuwendijk et al.

[11] 4,272,727

[45] Jun. 9, 1981

[54] SELF-CONVERGING DEFLECTION UNITS FOR COLOR DISPLAY TUBES OF DIFFERENT SCREEN FORMATS

[75] Inventors: Joris A. M. Nieuwendijk; Nicolaas G. Vink; Werner A. L. Heijnemans, all of Eindhoven, Netherlands

[73] Assignee: U.S. Philips Corporation, New York, N.Y.

[21] Appl. No.: 68,371

[22] Filed: Aug. 21, 1979

[30] Foreign Application Priority Data

Aug. 25, 1978 [NL] Netherlands ..... 7808775

[51] Int. Cl.[3] ..... H01F 5/00

[52] U.S. Cl. ..... 335/213; 335/210

[58] Field of Search ..... 335/210, 212, 213

[56] References Cited

U.S. PATENT DOCUMENTS

| | | | |
|---|---|---|---|
| 4,041,428 | 8/1977 | Kikuchi et al. | 335/210 |
| 4,122,422 | 10/1978 | Hasegawa et al. | 335/210 X |

*Primary Examiner*—George Harris

*Attorney, Agent, or Firm*—Thomas A. Briody; William J. Streeter; Laurence A. Wright

[57] ABSTRACT

A method of composing self-converging deflection units for color display tubes of the in-line type having the same deflection angles and neck diameters but different screen formats, in which for all screen formats one and the same design of the deflection unit is used, which deflection unit is self-converging for a color display tube of a given screen format and is made self-converging for a color display tube of a different screen format by varying the effective lengths of the line and field deflection coils constructed as saddle-shaped coils of the shell type in opposite senses with the position of their front ends remaining the same.

6 Claims, 8 Drawing Figures

SELF-CONVERGING DEFLECTION UNITS FOR COLOR DISPLAY TUBES OF DIFFERENT SCREEN FORMATS

BACKGROUND OF THE INVENTION

The invention relates to a series of at least two electro-magnetic deflection units for colour display tubes of the in-line type having the same deflection angles and neck diameters but at least two different screen formats, in which each deflection unit is provided with:

a first deflection coil having a front end and a rear end for deflecting electron beams generated in the display tube in a vertical direction, the electron beams, when the deflection unit has been mounted on a display tube, passing through the coil in the direction from the rear end towards the front end, as well as a second deflection coil, which coil is of the saddle type and also has a front end and a rear end, for deflecting electron beams generated in the display tube in a horizontal direction, a yoke ring of ferromagnetic material being provided around the at least the second deflection coil.

For some time a colour display tube has become the vogue in which three electron beams are used in one plane; the type of such a cathode ray tube is sometimes referred to as "in-line." In this case, for decreasing convergence errors of the electron beams, a deflection unit is used having a line deflection coil which, for deflecting the electron beams in a horizontal direction, generates a pin-cushion field, and a field deflection coil which, for deflecting the electron beams in a vertical direction, generates a barrel-shaped field. Within the scope of the invention, such a deflection unit may comprise in particular the combination of a field deflection coil of the so-called saddle shell type with a line deflection coil of the so-called saddle shell type. A coil of the saddle type is to be understood to mean herein a coil which is constructed from two coil halves, the front and rear ends of each coil half extending approximately perpendicularly to the plane in which the electron beams lie, and a coil of the saddle shell type is to be understood to means herein a coil which is constructed from two coil halves in which the front end of each coil half extends approximately perpendicularly to the plane in which the electron beams lie, and the - cylindrical - rear end is adapted to the outer surface of the neck part of the display tube.

Deflection units for in-line colour display tube systems can in principle be made to be entirely self-convergent, that is to say in a design of the deflection unit which insures convergence of the three electron beams on the axes, anisotropic y-astigmatism errors, if any, can simultaneously be made zero in the corners without this requiring extra correction means. Where it would be interesting from a point of view of manufacture to have a deflection unit which is self-converging for a series of display tubes of the same deflection angles and neck diameters but different screen formats, the problem exists, however, that a deflection unit of given main dimensions can be used only for display tubes of one screen format. This means that only one screen format can be found for a fixed maximum deflection angle in which a given deflection unit is self-converging without a compromise (for example, the use of extra correction means).

It is the object of the invention to provide a method of the kind mentioned in the opening paragraph with which it is possible, starting from deflection coils having given main dimensions, to compose self-converging deflection units for a series of display tubes of different screen formats.

Within the scope of the invention this object is achieved in that for a given screen format the first and the second coil each have a given effective length between their front and rear ends, the effective length of the first coil being larger and for the effective length of the second coil being smaller for a larger screen format, and conversely, so as to provide for different screen formats a self-converging combination of display tube/deflection unit.

The invention is based on the recognition of the fact that, if self-convergence on the axes has been reached, the possibly remaining anisotropic y-astigmatism error (the so-called y-convergence error in the corners) mainly depends on the distance between the line deflection point and the field deflection point and to a much smaller extent on the main dimensions and the shape of the deflection coils used. Now if deflection units for different screen formats are to be composed while using deflection coils having the same shape and main dimensions, the distance between the line and field deflection points may be used as a parameter to nevertheless achieve self-convergence for a family of display tubes having different screen formats but the same maximum deflection angles.

Within the scope of the invention, the variation in the distance between the line and field deflection points necessary for adapting to different screen formats is achieved by increasing or decreasing the effective coil length of either the line coil or the field coil, or of both but then in the opposite sense, with the main dimensions of the deflection coils remaining the same and with the dimensions of the yoke ring remaining the same, for example, by mechanically making the coil or coils on the rear side smaller and longer, respectively, by a few millimeters, or by positioning, with the coil length remaining the same, the window farther or less far to the rear (so that the turns on the rear side are more or less compressed). As will be explained hereinafter, all this can be carried out very simply in practice when saddle-shaped coil halves of the shell type are used at least for the line coil and preferably also for the field coil.

The invention actually involves that, for use of a deflection unit in a display tube having a larger screen format than the display tube for which it is designed, the deflection points of the line deflection field and field deflection field generated by the given deflection unit must be moved apart and, for use in a display tube having a smaller screen format, they must be moved towards each other.

The use of the invention results, in particular, in a series of at least two combinations display tube/deflection unit, the display tubes having the same neck diameters and deflection angles but different screen formats, each deflector unit comprising:

a first deflection coil of the saddle type having a front end and a rear end for deflecting electron beams generated in the display tube in a vertical direction, the electron beams, when the deflection unit has been mounted on a display tube, passing through the coil in the direction from the rear end towards the front end:

a second deflection coil of the saddle type also having a front end and a rear end for deflecting electron beams generated in the display tube in a horizontal direction, as well as a yoke ring of ferromagnetic material surrounding the two deflection coils, which series is characterized in that the first and second deflection coils at their front ends have a cup-shaped portion which is adapted to the outer surface of the display tube, and at their rear ends have a cylindrical portion which is adapted to the surface of the display tube on the one hand the dimensions and the shape of the cup-shaped portion of the first deflection coils and on the other hand the shape and the dimensions of the cup-shaped portion of the second deflection coils in display tubes of different screen formats being the same, the effective length of the cylindrical portion of the first coil increasing and that of the second deflection coil decreasing when the screen format of the display tube for which they are mounted increases, and conversely. (An example of a series of display tubes is, for example, a series having a constant deflection angle of 110° and 20, 22 and 26 inch screens).

As will be described in greater detail hereinafter with reference to the method of the invention, the great advantage of the invention is that for adaptation to the various screen formats of a given series, only a very small alteration in the length of the (cylindrical) rear section of the individual deflection coils is necessary to obtain the desired variation in the distance between the deflection points. This means that the complicated cup-shaped portion may remain unvaried as regards dimensions so that self-converging deflection coils for display tubes of different screen formats can be made by means of one jig (having an adjustable rear section). In order to maintain convergence on the axes, the wire distribution in the cup-shaped portion of the coils needs at most only small alterations and in fact this applies only to the line coil. The main geometry, however, remains unchanged.

The invention therefore also relates to a method of assembling electromagnetic deflection units for colour display tubes of the in-line type having the same deflection angles and neck diameters but at least two different screen formats in which a first deflection coil of the saddle type having a front end and a rear end, a cup-shaped portion at the front end and a cylindrical portion at the rear end, for deflecting electron beams generated in the display tube in a vertical direction, the electron beams, when the deflection unit has been mounted on a display tube, passing through the coil in the direction from the rear end towards the front end, is combined with a second deflection coil, which coil is of the saddle type and has a front end and a rear end, a cup-shaped portion at its front end and a cylindrical portion at its rear end, for deflecting electron beams generated in the display tube in a horizontal direction, a yoke ring of ferromagnetic material being provided around the assembly of the two deflection coils, characterized in that at least the second deflection coil is composed of two identical halves which are wound on a jig having a cup-shaped portion and a cylindrical portion. The shape and the dimensions of the cup-shaped portion being the same for each screen format, the cylindrical portion of the jig, however, having an adjustable body for determining the length of the cylindrical portion of the coil halves.

A variation $\Delta D$ in the distance between line and field deflection point is produced by varying the effective length of the line coil with respect to that of the field coil. $\Delta D$ is linearly associated with the variation of the screen format, in which the relation applies that:

$$\Delta D = \beta \Delta Z_s,$$

where $\Delta Z_s$ is the variation in the distance from the front end of the coil situated nearest to the screen (this generally is the line coil) to the screen. The value of $\beta$ is roughly between 0.05 and 0.15.

BRIEF DESCRIPTION OF THE DRAWING

Embodiments of the invention will now be described in greater detail, by way of example, with reference to the accompanying drawing, in which.

DESCRIPTION OF THE PREFERRED EMBODIMENTS

Figure 1:
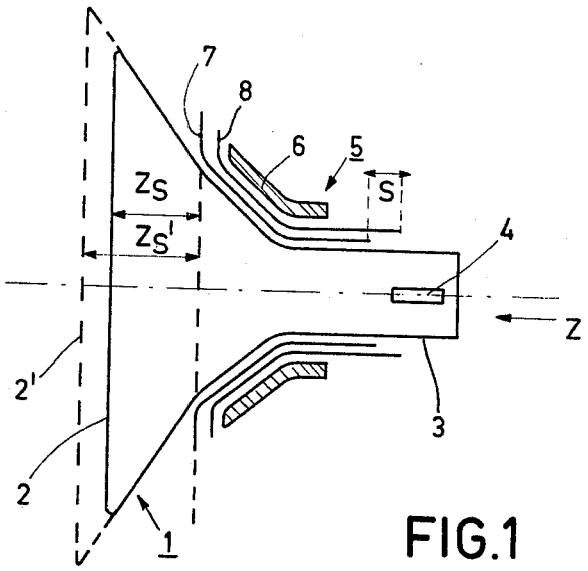
FIG. 1 shows diagrammatically a colour display tube having a deflection unit.

FIG. 1 is a diagrammatic sectional view of a colour display tube 1 of the in-line type having a display screen 2, a tube neck 3 and three electron guns 4 situated in one plane. A deflection unit 5 connected to the display tube comprises a rotationally symmetric yoke ring 6, a saddle coil 7 of the shell type for the horizontal deflection (the so-called line coil) and a saddle coil 8 of the shell type for the vertical deflection (the so-called field coil).

It has been found that, starting from a given main geometry of line and field coil, the variation of the effective lengths of the line coil and the field coil with respect to each other is a very helpful parameter to adjust the third order anisotropic astigmatism. The correction of the third order anisotropic astigmatism by mutual shifting of the deflection points is roughly ten times faster than by shifting the deflection unit as a whole.

It has so far been generally believed that also in the construction of in-line deflection systems it was not allowed to deviate from the requirement accepted in the construction of delta deflection systems that line and field deflection centres should coincide and should remain coinciding upon deflection. As will be explained hereinafter, the invention is based on the fact that in a deflection unit of the in-line type destined for use in combination with picture tubes having an (uninterrupted) line structure of the phosphors, the location of line and field deflection centres can just be optimalised in behalf of convergence and raster performance.

Of late years a development has occurred in colour television display systems which may be characterized by:

the change of the delta arrangement of electron guns into an in-line arrangement in which the associated deflection system has been developed from non-self-converging to self-converging;

the change of the hexagonal mask structure of the display tube in to a line structure.

Where such a system must satisfy requirements as regards convergence, raster shape and purity (colour purity, landing reserve), requirements may be derived which each of the components of said system should satisfy (think, for example, of the specific wire distribution for self-convergence).

Where purity is concerned, the general situation is that a deflection unit is given (which satisfies certain requirements as regards convergence, raster and shifting space), it being one of the responsibilities of the display tube designers to develop such an analog of the electron-optical properties of said deflection unit that during the manufacture of the display screen the exposure optics insure that the (visual) exposure "centre" and the deflection "centre" will afterwards coincide.

Because for a delta-gun arrangement coupled to a non-self-converging deflection unit the triodistortion (and the variation in deflection point), upon deflection, results already in conflicting requirements to be imposed upon the exposure optics, a generally accepted requirement imposed from purity on the properties of the deflection unit is that in a delta system:

line and field deflection points should coincide and should go on coinciding upon deflection.

In in-line self-converging colour television display systems, the variation in deflection point of line and field coil is already so different in character that it was deemed necessary to abandon the hexagonal mask structure which was substantially ideal as regards purity properties and to proceed to a line structure. Said line structure is characterized by a phosphor line which is uninterrupted in the field direction (which, with invisibility requirements imposed upon the mask structure remaining the same, has half the width of the original round phosphor dot).

These phosphor lines which are uninterrupted in the direction of the picture has the favourable result that in this direction in principle no mislanding (= not landing of a beam on a dot of its own colour) can occur.

As a result of this, the differing variation in deflection point of the field coil with respect to the line coil can easily be permitted.

In that case, it is in principle of no importance any longer for purity whether line and field deflection points will coincide also in the case of a deflection over a very small angle.

In other words, the generally accepted requirement in a delta system that in a deflection unit line and field deflection points will coincide and will go on coinciding upon deflection may be omitted in an in-line system when the hexagonal mask structure in the display tube is replaced by a line mask structure. (N.B.: so this is not a result of the in-line arrangement of the electron guns in themselves).

Within the scope of the invention this is used in the adaptation of the deflection unit 5 to a display tube having a screen 2' of a screen format different from that of the display screen 2 (in this case larger) but of equal deflection angle and neck diameter.

How this adaptation works is shown in more detail in FIGS. 2, 3, 4, 5 and 6.

Figure 2:
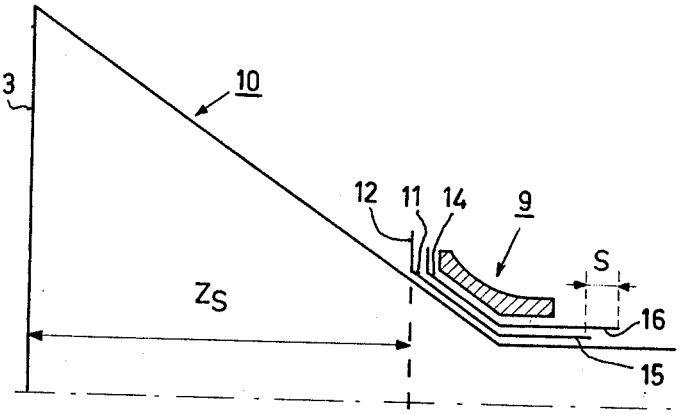
FIG. 2 shows diagrammatically a deflection unit according to the invention suitable for a colour display tube having a first screen format.

FIG. 2 is a side elevation of the part of a deflection unit 9 situated above the tube axis and provided on a display tube 10. Deflection unit 9 comprises a line coil 11 having a front end 12 situated at a distance $Z_s$ from the display screen 13, and a field coil 14. In order that the deflection unit 9 be self-converging on the display tube 10 (for example, a 110° tube having a 20 inch screen), the end 16 of the field deflection coil 14, as well as the end 15 of line deflection coil 12 has a given length. The distance between the rear end 15 of the line deflection coil 12 and the rear end 16 of the field deflection coil 14 is denoted by S.

Figure 3:
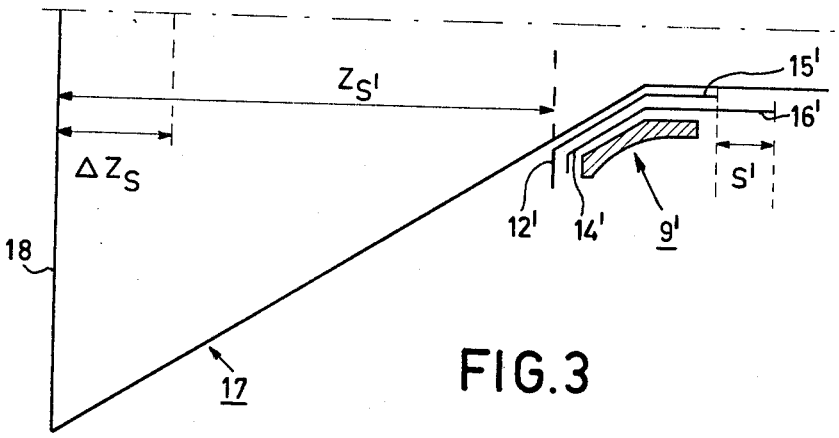
FIG. 3 shows diagrammatically the same deflection unit as in FIG. 2 but now adapted to a colour display tube of a second screen format.

FIG. 3 shows a modified deflection unit 9', in this case the part situated below the tube axis, and shows that the distance S is changed into the distance S' where $S'-S=\Delta S$, by varying the lengths of the parts of the coils extending parallel to the tube axis. The deflection unit 9' is now self-converging on a display tube 17 having a second (larger) screen format (for example, a 110° tube having a 22 inch screen). In the present case the field deflection coil 14 has for this purpose been extended on its rear side by approximately 5 mms and the line deflection coil 12' has been shortened on its rear side by approximately 5 mms, while the screen format is changed by 2 inches, which is shown in FIG. 3 by the distance $\Delta Z_s$ by which the distance from the front end of the line deflection coil 12' to the display screen 18 has been increased from $Z_s$ to $Z_s'$.

Figure 4:
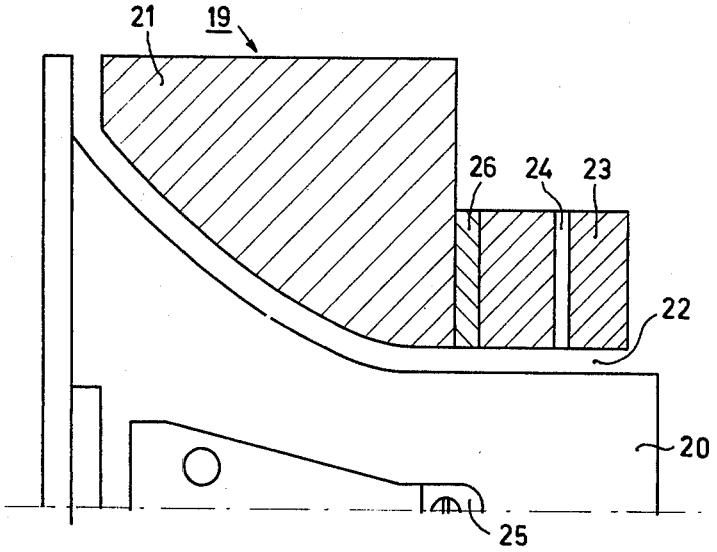
FIG. 4 shows diagrammatically a jig to be used in the method according to the invention and having an adjustable rear section.

Changing the length of, for example, the field deflection coil is realised by means of a jig 19 which is shown in FIG. 4 diagrammatically partly as a plan view and partly as a sectional view. It consists of a (brass) lower jig 20 and a (brass) upper jig 21 which are separated from each other by a winding slot 22 where a winding wire is inserted. Holes to shoot pins into the rear end of a coil have been made in a cylindrical portion 23 which is screwed to the upper jig 21. One of these holes is denoted by 24. These pins together with an exchangeable window block 25 screwed to the lower jig 20 determine the place where the copper wires bend on the rear side of the coil and hence determine the length of the deflection coil.

By placing a cylindrical auxiliary plate 26 of the required thickness between the upper jig 21 and the cylindrical component 23 and simultaneously adapting the window block 25 as regards length, the jig can simply be made suitable for winding another coil from the same family. The profiled member on the cup side which is difficult to manufacture is not changed. Dies and winding wings need not be varied either. Preferably the lengths of the line and field deflection coils are varied in the opposite sense when changing to another format, so that the differences between the coils from the whole family do not become too large (see also FIG. 2, 3).

Figure 5:
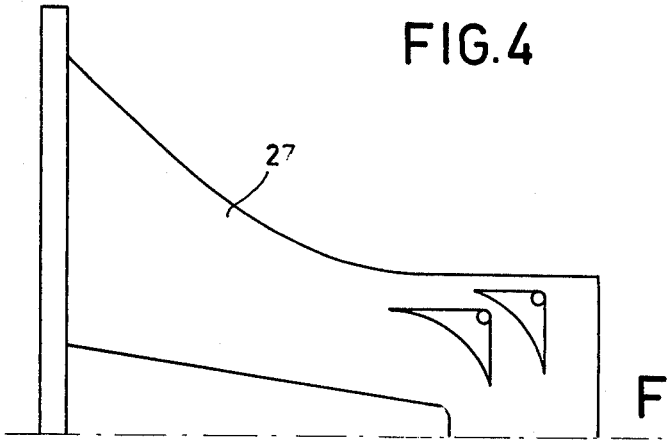
FIG. 5 is a side-elevation of a field coil half as used in the deflection unit shown in FIG. 2.
Figure 6:
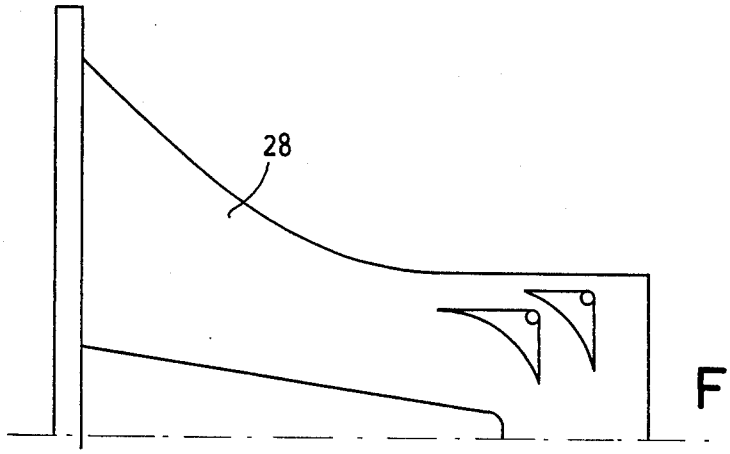
FIG. 6 is a side elevation of a field coil half as used in the deflection unit shown in FIG. 3.

FIG. 5 is a plan view of one half of the field deflection coil 27 and FIG. 6 is a plan view of one half of the field deflection coil 28 having an elongated rear end manufactured in the above-described manner.

Figure 7:
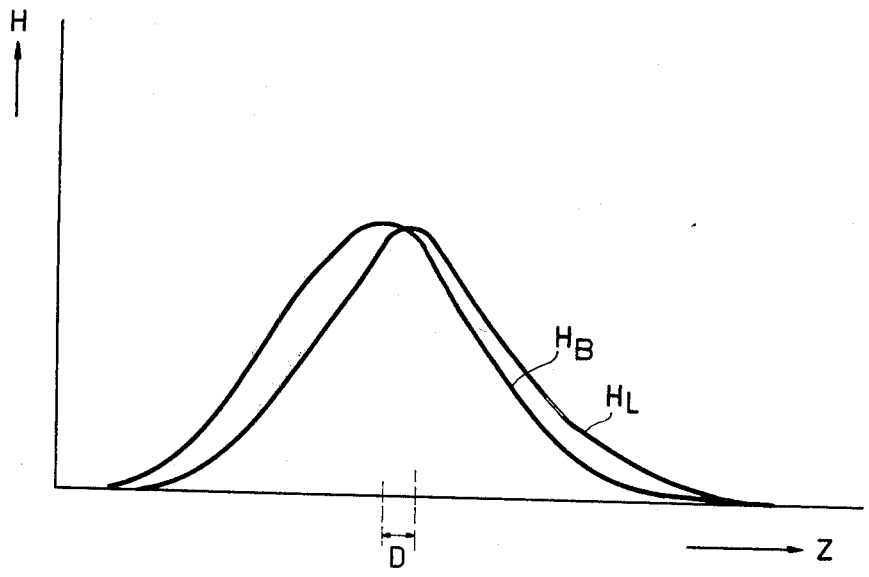
FIG. 7 shows the magnetic fields generated in the axial direction by the deflection unit shown in FIG. 2.

By varying the distance between the rear ends of the line and field deflection coils, the distance between the line and field deflection point is varied and hence a deflection unit is obtained which is self-converging for another screen format. This is explained in FIGS. 7 and 8. A field deflection field $H_B$ and a line deflection field $H_L$ are generated by means of a deflection unit as shown in FIG. 2. The field distribution measured in the direction of the axis of the display tube is as shown in FIG. 7. The maximum values of the two fields defining the Gauss deflection points are a distance D apart.

Figure 8:
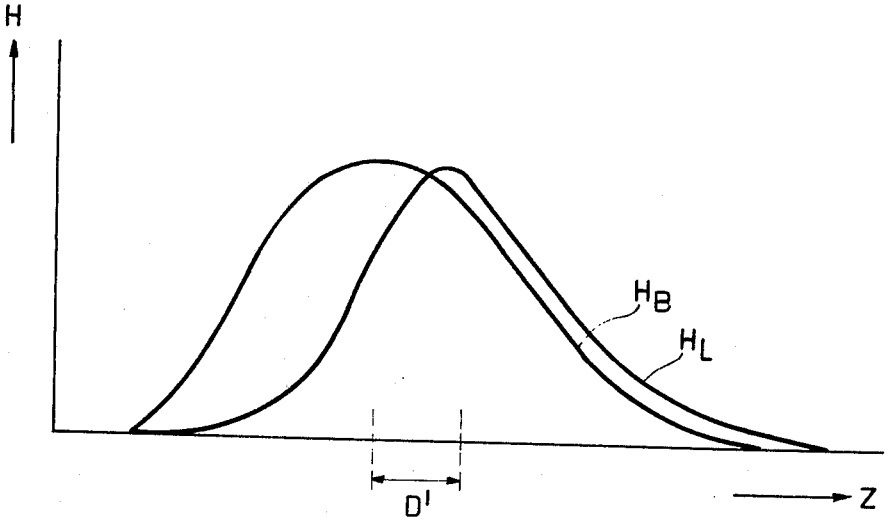
FIG. 8 shows the magnetic fields generated in the axial direction by the deflection unit shown in FIG. 3.

A field deflection field and a line deflection field having a field distribution as shown in FIG. 8 are generated by means of a deflection unit as shown in FIG. 3. In this case the distance between the Gauss deflection points is D', with $D'-D=\Delta D$.

For $\Delta D$ the relation holds that $\Delta D=\beta\Delta Z_s$, where $0.05<\beta<0.15$, and $\Delta Z_s$ (see FIG. 3) is the change in the distance between the front end of the line deflection coil and the screen when changing to a different screen format.

What is claimed is:

1. A series of at least two electromagnetic deflection units for colour display tubes of the in-line type having the same deflection angles and neck diameters but at least two different screen formats, in which each deflection unit has:

a first deflection coil having a front end and a rear end for deflecting electron beams generated in the display tube in a vertical direction, the electron beams, when the unit has been mounted on a display tube, passing through the coil in the direction from the rear and to the front end, a second deflection coil, which coil is of the saddle type and also has a front end and a rear end, for deflecting electron beams generated in the display tube in a horizontal direction, as well as a yoke ring of ferromagnetic material surrounding at least the second deflection coil, wherein for a given screen format the first and the second coil each have a given effective length between their front and rear ends, the effective length of the first coil being larger and/or the effective length of the second coil being smaller for a larger screen format, and conversely, so as to provide for different screen formats a self-converging combination of display tube/deflection unit.

2. A series of deflection units as claimed in claim 1, wherein the deflection coils at their front ends have a cup-shaped portion and at their rear ends have a cylindrical portion, the shape and the dimensions of the cup-shaped portion of the first deflection coils being equal for different screen formats and the shape and the dimensions of the cup-shaped portion of the second deflection coils being equal for different screen formats, the length of the cylindrical portion of the first coil increasing and/or that of the second deflection coil decreasing when the screen format of the display tube increases, and conversely.

3. A series of at least two combinations of display tube deflection unit, in which the display tubes have equal neck diameters and deflection angles but different screen formats and in which each deflection unit has:

a first deflection coil of the saddle type having a front end and a rear end for deflecting electron beams generated in the display tube in a vertical direction, the electron beams, when the deflection unit has been mounted on a display tube, passing through the coil in the direction from the rear end to the front end:

a second deflection coil of the saddle type, also having a front end and a rear end, for deflecting electron beams generated in the display tube in a horizontal direction, as well as a yoke ring of ferromagnetic material surrouding the two deflection coils, wherein the first and second deflection coils at their front ends have a cup-shaped portion adapted to the outer surface of the display tube and at their rear ends have a cylindrical portion adapted to the outer surface of the display tube, in which on the one hand the shape and dimensions of the cup-shaped portion of the first deflection coils in display tubes having different screen formats are the same and on the other hand the shape and dimensions of the cup-shaped portion of the second deflection coils in display tubes having different screen formats are the same, and in which the length of the cylindrical portion of the first coil increases and that of the second coil decreases when the screen format of the display tube on which they are mounted increases, and conversely.

4. A series of combinations of display tube deflection unit as claimed in claim 3, characterized in that the series comprises at least one combination of a display tube of a first screen format having a first deflection unit, in which the distance between the display screen and the front end of the deflection coil situated nearest to the display screen is $Z_s$, and the distance between the deflection points of the fields generated by the deflection coils of the first deflection unit is D, and furthermore comprises at least one combination of a display tube of a second screen format with a second deflection unit, in which the distance between the display screen and the front end of the deflection coil of the second deflection unit situated nearest to the display screen is $Z_s'$ and the distance between the deflection points of the fields generated by the deflection coils of the second deflection unit is D', where $D-D'=\beta(Z_s-Z_s')$, and $0.05<\beta<0.15$.

5. A method of assembling electromagnetic deflection units for colour display tubes of the in-line type having the same deflection angles and neck diameters but at least two different screen formats in which a first deflection coil of the saddle type having a front end and a rear end, a cup-shaped portion at the front end and a cylindrical portion at the rear end, for deflecting electron beams generated in the display tube in a vertical direction, the electron beams, when the deflection unit has been mounted on a display tube, passing through the coil in the direction from the rear end towards the front end, is combined with a second deflection coil, which coil is of the saddle type and has a front end and a rear end, a cup-shaped portion at its front end and a cylindrical portion at its rear end, for deflecting electron beams generated in the display tube in a horizontal direction, a yoke ring of ferromagnetic material being provided around the assembly of the two deflection coils, wherein at least the second deflection coil is composed of two identical halves which are wound on a jig having a cup-shaped portion and a cylindrical portion, the shape and the dimensions of the cup-shaped portion being the same for each screen format, the cylindrical portion of the jig, however, having an adjustable body for determining the length of the cylindrical portion of the coil halves.

6. A method as claimed in claim 5, characterized in that the coil halves of the two deflection coils are wound on a jig having an adjustable body for determining the length of the cylindrical portion of the coil halves.

* * * * *